United States Patent [19]

Palladino, Jr.

[11] Patent Number: 4,620,709

[45] Date of Patent: Nov. 4, 1986

[54] BOARD GAME AND METHOD

[75] Inventor: John R. Palladino, Jr., Brighton, Mich.

[73] Assignee: Game Concepts, Inc., Brighton, Mich.

[21] Appl. No.: 599,815

[22] Filed: Apr. 13, 1984

[51] Int. Cl.[4] ..... A63F 3/02; A63F 3/06; A63F 9/06

[52] U.S. Cl. ..... 273/264; 273/271; 273/153 S

[58] Field of Search ..... 273/264, 271, 109, 110, 273/115, 281

[56] References Cited

U.S. PATENT DOCUMENTS

| | | | |
|---|---|---|---|
| 448,019 | 3/1891 | Garben | 273/153 S |
| 1,085,941 | 2/1914 | Russell | 273/281 |
| 2,788,974 | 4/1957 | Pick | 273/115 |
| 3,778,063 | 12/1973 | Strand | 273/271 X |
| 4,210,337 | 7/1980 | Obermair | 273/264 |
| 4,303,246 | 12/1981 | Strongin | 273/271 |

OTHER PUBLICATIONS

*The Way to Play,* Diagram Group, Apr. 1976, p. 56.

"Nine Men's Morris", *Games of the World,* ©1975, Holt, Rinehart and Winston, pp. 59–61.

*Primary Examiner*—Richard C. Pinkham
*Assistant Examiner*—Benjamin Layno
*Attorney, Agent, or Firm*—Gifford, Groh, VanOphem, Sheridan, Sprinkle & Dolgorukov

[57] ABSTRACT

There is disclosed a board game and a method of playing the same. The game board used in the game comprises a playing surface with a first plurality of spaced apart pathways on the surface of the game board, and a second plurality of spaced apart pathways on the game board intersecting the first plurality of pathways. A continuous interconnecting pathway connecting all of the first plurality and the second plurality of pathways may be provided if desired. In addition, the game board may be three dimensional in nature, and the pathways may be recessed into the playing surface of the game board if desired. Regardless of which of the several modifications of the game board is used, the method disclosed has as its object to align the playing pieces such that two rows of like colored playing pieces will win the game, regardless of whether any one of the rows so formed is vertical, horizontal or diagonal.

23 Claims, 15 Drawing Figures

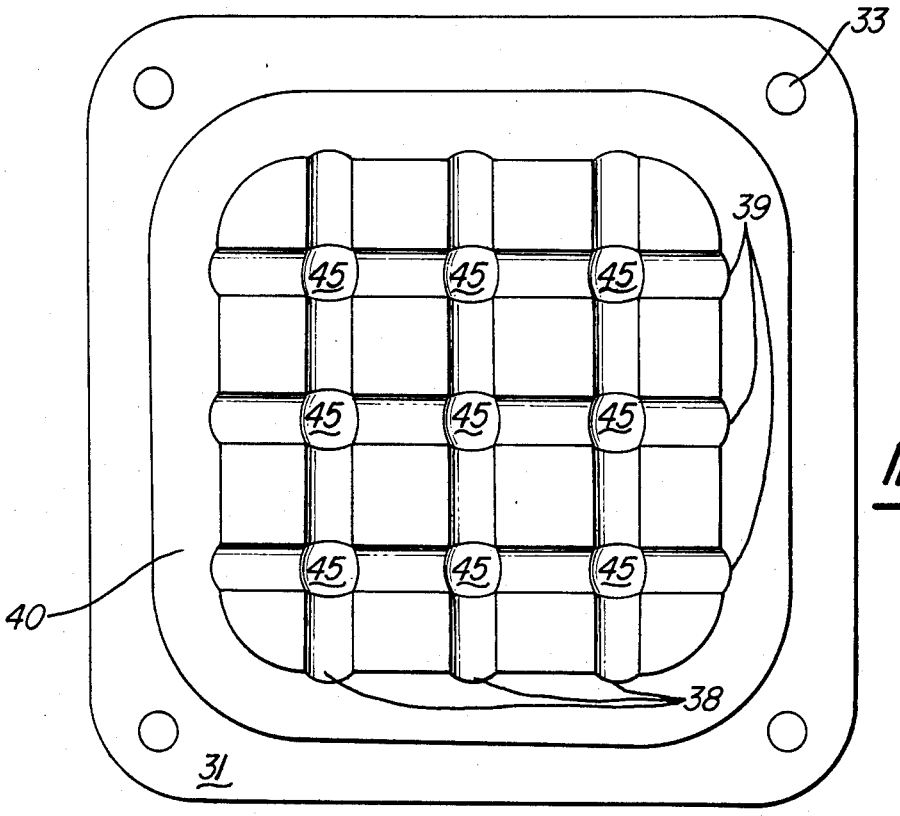
Fig-9
Fig-10
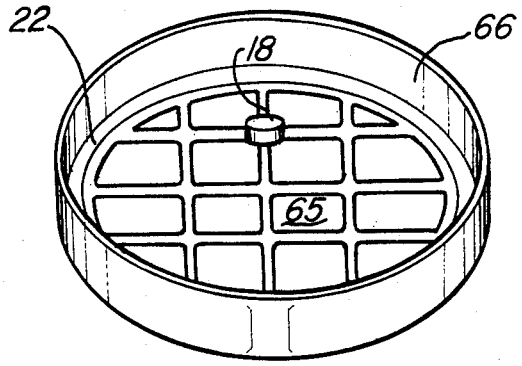
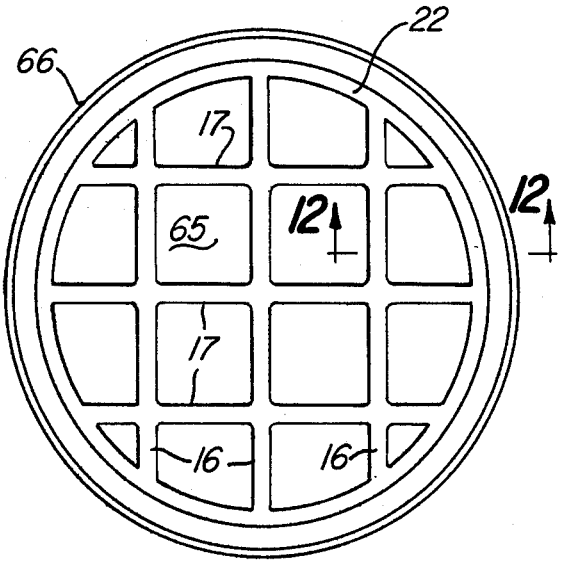
Fig-11
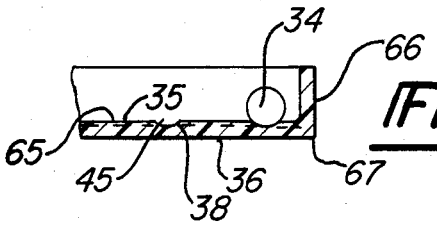
Fig-12

BOARD GAME AND METHOD

FIELD OF THE INVENTION

The present invention relates to board games and methods of play thereof, and more particularly to a board game having movable playing pieces adapted to be moved along a plurality of intersecting pathways of movement until two rows of a like color are formed, at which time the player having that color of playing piece wins the game. As will be discussed above, there may be three or more sets of intersecting pathways of movement, and two or more colors of playing pieces.

BACKGROUND OF THE INVENTION

As one familiar with the board game art, I am aware that many board games are available which involve the movement of playing pieces along various pathways of movement. Such games range from those such as Tic-Tac-Toe, where game pieces are moved on pathways of movement consisting of the squares formed by intersecting parallel lines, to various other games wherein playing pieces are moved along recessed tracks and the like.

Before filing a patent application for my improved board game and method of play thereof, I caused a search to be made through the records of the U.S. Patent and Trademark Office and located the following patents and other pieces of prior art:

| U.S. Pat. No. | Title | Date |
|---|---|---|
| 701,484 | George N. Johnson | 1902 |
| 970,257 | McDonald et al. | 1910 |
| 1,299,391 | T.J. Sylvester | 1919 |
| 2,753,187 | N.J. Orsini | 1956 |
| 2,788,974 | Pick | 1957 |
| 3,603,589 | Sonntag | 1971 |
| | Breck Catalog | 1970 |

The above-listed prior art is relevant to the present invention only in that it discloses board games using spherical playing pieces, which are used in one modification of my invention, and does disclose recesses into which the spheres or balls may come to rest. However, none of them disclose the particular combination of features found in my invention, i.e. a plurality of intersecting passageways, with or without an interconnecting passageway connecting the ends of the intersecting passageways, and none of them disclose the idea of needing to have two rows of a like color in order to win the game. Thus, even though this is the best prior art of which I am aware, it is my opinion that it does not affect the patentability of my invention.

BRIEF SUMMARY OF THE INVENTION

Board games presently available involve the movement of game playing pieces of various shapes, sizes and colors generally along fixed or random paths of movement. When the paths of movement are random, as disclosed in U.S. Pat. No. 3,603,589 to Sonntag disclosed above, there are no fixed ways to move, or no number of playing pieces to arrange in a row or the like to win. Instead, it is the first to get all of the balls into the outer groove, for example.

In contrast, board games involving fixed paths of movement, such as the Tic-Tac-Toe game disclosed, or the game of checkers for example, involve straight or diagonal paths of movement along squares defined by real or imaginary pluralities of intersecting parallel lines, and not along the lines themselves.

In many of these games, such as in Tic-Tac-Toe, one must get three playing pieces of a like color, or three X's or three O's in a row to win the game. This has produced types of games in which the object of playing an interesting and challenging game can be defeated by an experienced player by knowing certain moves, such as the second player in Tic-Tac-Toe always placing his mark or playing piece in the center square on his first move, and this has removed a lot of challenge from this type of game.

Thus, it is one of the objects of the present invention to provide a challenging board game which cannot have its purpose of play easily defeated by a known move.

It is a further object of the present invention to provide a board game having movement of game pieces provided along intersecting pathways of movement, rather than along the shapes formed by said intersecting pathways.

It is a further object of the present invention to provide a board game where at least two rows of like colored playing pieces must be placed on the board to win the game.

It is a further object of the present invention to provide a board game of the foregoing nature which can be easily adapted for additional players by providing additional intersecting pathways of movement, and additional numbers of playing pieces for each additional player.

Further objects and advantages of my invention will be apparent from the following description and appended claims, reference being had to the accompanying drawings forming a part of the specification, wherein like reference characters designate corresponding parts in the several views.

BRIEF DESCRIPTION OF THE DRAWINGS

FIG. 9 is a sectional view of the construction shown in FIG. 6 taken in the direction of the arrows along the section line 9—9 of FIG. 6.

FIG. 10 is a perspective view of a further modification of a construction embodying my invention wherein a two-dimensional game board is used having a circular retaining wall for the purpose of maintaining the game pieces on the playing surface.

FIG. 11 is a plan view of the construction shown in FIG. 10.

FIG. 12 is a partial sectional view showing a modification of the construction shown in FIGS. 10 and 11.

It is to be understood that the present invention is not limited in its application to the details of construction and arrangement of parts illustrated in the accompanying drawings, since the invention is capable of other embodiments, and being practiced or carried out in various ways within the scope of the claims. Also, it is to be understood that the phraseology and terminology employed herein is for the purpose of description, and not of limitation.

DETAILED DESCRIPTION OF THE DRAWINGS

Figure 1:
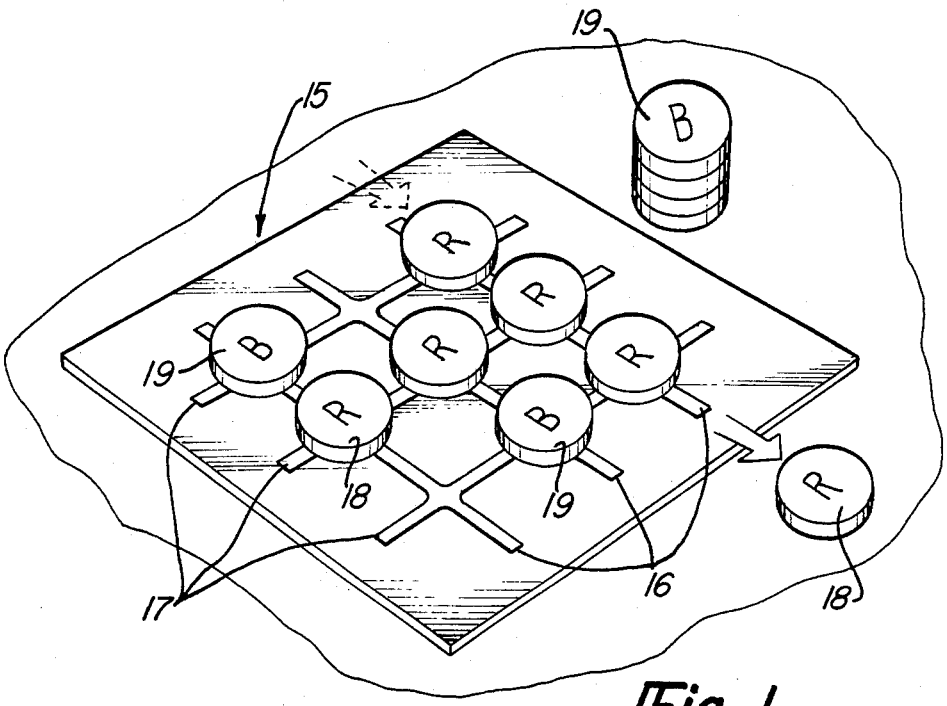
FIG. 1 is a perspective view of a two-dimensional game board embodying my invention showing a plurality of playing pieces in two colors.

Referring now to FIG. 1, there is shown a perspective view of the most basic version of my invention. A two-dimensional game board having a playing surface, generally designated by the numeral 15, and a first plurality of spaced apart pathways thereon consisting of the three vertical linear pathways individually designated by the numeral 16.

A second plurality of spaced apart pathways appears on the board and consists of the three horizontal linear pathways 17. The first plurality of spaced apart pathways, in the form of the three vertical linear pathways 16, can be seen to intersect the second plurality of spaced apart pathways consisting of the three horizontal linear pathways 17.

Shown spaced at the intersections of the vertical linear pathways and the horizontal linear pathways are a plurality of game pieces. The six red game pieces are designated by the numeral 18, while the six black game pieces are designated by the numeral 19.

In the embodiment of my invention shown in FIG. 1, which is intended for two players, it is desirable, although not necessary, that the number of playing pieces for each player be equal to the number of linear pathways. In this case, since there are six linear pathways, each player should have six pieces of his particular color, and additional red game pieces 18 and black game pieces 19 are shown stacked off to the side of the game board.

To play the game, each player alternately moves one playing piece on to one of said vertical pathways 16 or said horizontal pathways 17, whether occupied or not. The players continually do this until two rows of like colored playing pieces are formed, regardless of whether any one row is horizontal vertical or diagonal. The two rows formed by the playing pieces do not need to connect, but one playing piece may be common to both rows. The playing pieces may be moved forward or backward on either of pathways 16 or 17.

Since the pathways will often be occupied by one or more playing pieces when a player wants to move his piece into one, often times an entire row of playing pieces may suddenly be shifted out of positions that had carefully been planned by the players, and upset their strategy. Thus, it can be seen that unexpected and exciting action will be continually taking place.

The only other rule being applicable is that a player may not reverse the immediately proceeding move of the other player. In this case, the player having the red pieces has won because he has filled a horizontal pathway with his red playing pieces, and has filled a connecting vertical pathway with his pieces.

Figure 2:
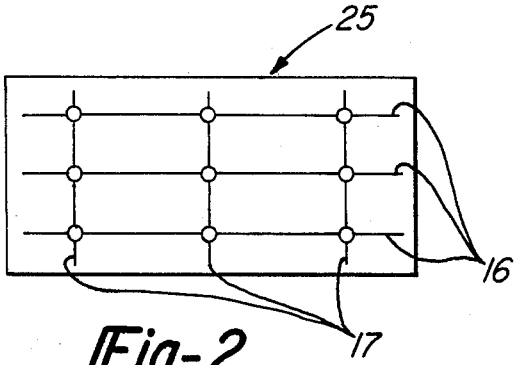
FIG. 2 is a plan view of a portion of a game board embodying my invention showing the intersecting pathways of movement forming rectangles thereon.

Alternate embodiments of game boards coming within the scope of my invention are shown in FIGS. 2–5. In FIG. 2, there is shown a first plurality of linear spaced apart pathways (horizontal pathways 16) and a second plurality of linear spaced apart pathways (vertical pathways 17) perpendicular to and intersecting said first plurality of linear spaced apart pathways to enclose rectangular areas between the lines forming the pathways. In this embodiment, the game board would be rectangular and, therefore, is designated by the numeral 25, rather than the numeral 15 used for the square game board.

Figure 3:
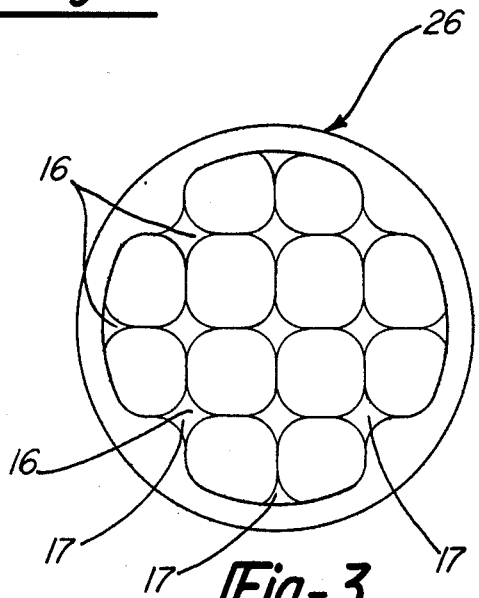
FIG. 3 shows a circular game board embodying the construction of my invention, and having two sets of three parallel pathways of movement intersecting in a perpendicular fashion.
Figure 4:
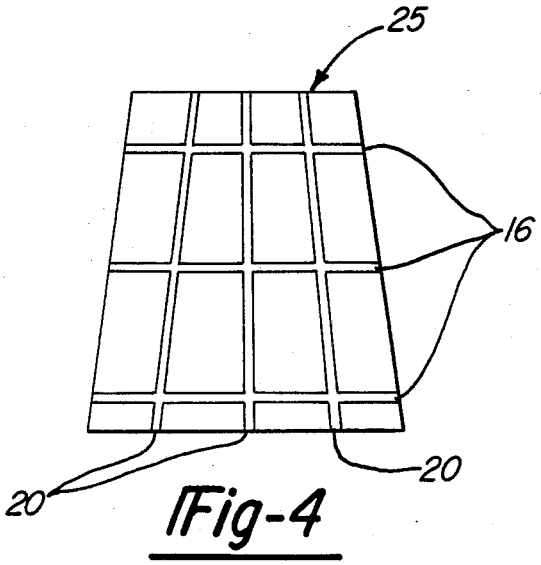
FIG. 4 is a fragmentary perspective view of a game board embodying my invention having a plurality of non-parallel intersecting pathways of movement, the pathways in the horizontal direction all being parallel, but the pathways in the vertical direction not possessing this property.

In FIG. 3, the same pathways appear on a circular game board 26. A first plurality of linear spaced apart parallel pathways of movement are designated by the numeral 16, while a second plurality of linear parallel spaced apart pathways are designated by the numeral 17. As in FIGS. 1 and 2, the first plurality of linear spaced apart pathways 16 and the second plurality of linear spaced apart pathways 17 are mutually perpendicular.

It should be understood, however, that the two pluralities of spaced apart pathways do not have to be perpendicular. In the embodiment shown in FIG. 4, each of the three vertical linear pathways 16 forming the first plurality of spaced apart pathways are parallel to each other, while none of the lines 20 forming the second plurality of spaced apart pathways are parallel to each other. Therefore, for any one of the lines 20, the angles formed by the intersection of the lines 20 and the vertical pathways 16 will form a set of angles different from that formed by any one of the other lines 20 intersecting the pathways 16.

Figure 5:
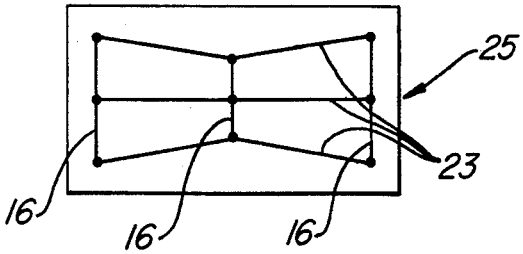
FIG. 5 is a plan view of a game board embodying my invention having a first and second plurality of spaced-apart pathways of movement.

As a last example of the many two-dimensional versions in which my game can be made, there is shown in FIG. 5 a rectangular game board 25 having a first plurality of linear spaced apart pathways formed by the vertical linear pathways 16 which are all parallel to each other. However, in this case, the lines 23 forming the second plurality of spaced apart pathways converge toward the middle line, and then diverge therefrom. It is obvious that many designs can be made and still embody my invention.

Figure 6:
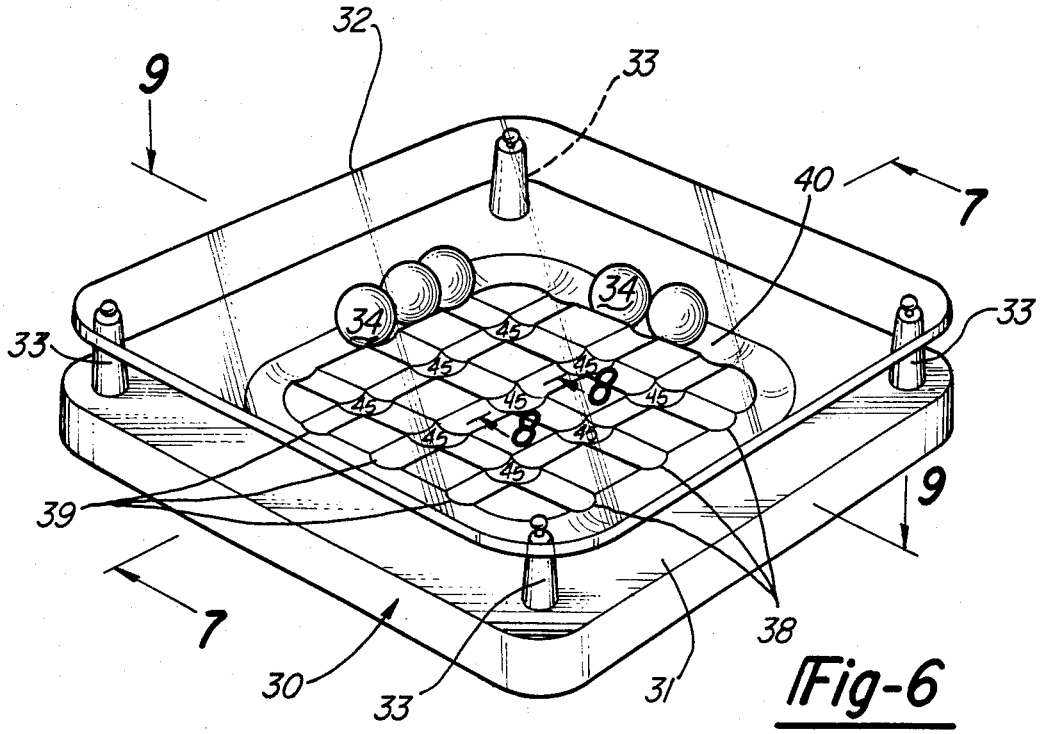
FIG. 6 is a perspective view of a modification of my invention wherein a three-dimensional game board is used.

For a more exciting and challenging version of my improved board game, there is shown in FIG. 6 a three-dimensional game board generally designated by the numeral 30. The board has a playing surface 35 and a lower surface 36, as well as a clear cover piece 32 supported by one or more posts 33.

The distance between the playing surface 35 of the game board 30 and the lower surface of the cover piece 32 is generally slightly less than the diameter of the spherical playing pieces 34 so that they will be prevented from rolling off the base 31 of the board. In this instance, the first plurality of linear spaced apart pathways on the game board 30 are formed by the three parallel vertical recesses 38 and the second plurality of linear spaced apart pathways are formed by the three horizontal recesses 39. A connecting pathway 40 encircles and connects all of the vertical recesses 38 and the horizontal recesses 39.

Figure 8:
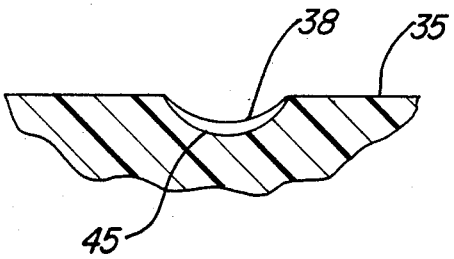
FIG. 8 is a sectional view taken in the direction of the arrows along the section line 8—8 of FIG. 6.

Stop means 45 are provided to hold the spherical playing pieces 34 in place at the intersections of the vertical recesses 38 and the horizontal recesses 39. As shown in FIG. 8, the stop means 45 may take the form of deeper dish-shaped recesses 48 provided at each intersection of a vertical recess 38 and a horizontal recess 39.

Figure 7:
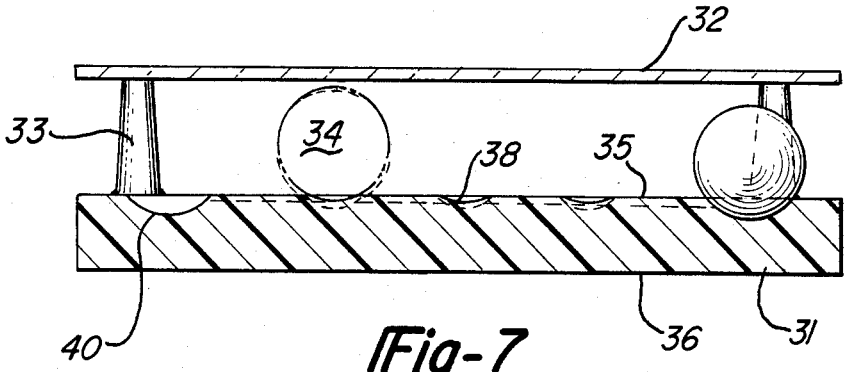
FIG. 7 is a sectional view taken in the direction of the arrows along the section line 7—7 of FIG. 6.

For ease of illustration, only a few of the spherical playing pieces 34 are shown in FIGS. 6 and 7. In actual play, as in the two-dimensional version of my game, each player will have an equal number of like colored playing pieces. For example, one player would have six red spheres, and the second would have six black spheres. As before, these could be moved back and forth along the vertical and horizontal recesses until two rows of like colored playing pieces are formed by a single player, regardless of whether any row is horizontal, vertical or diagonal. In this version of the game, the connecting pathway 40 makes a convenient means for moving the spherical playing pieces 34 to their proper position to make a move against the opponent's colored playing pieces.

I have thus far shown my board game in a two-dimensional version having checker-like playing pieces 18 and 19, and in a three-dimensional version having spherical playing pieces 34. In the three-dimensional version, the playing pieces 34 were restrained from moving off the game board by virtue of the cover piece 32 and the recessed pathways 38, 39 and 40. It should be understood, however, that it is completely within the scope of the present invention to have different means of restraining the playing pieces. For example, in the two-dimensional version, suitable materials could be used in the manufacture of the game board 15 and the playing pieces 18 and 19 so that a magnetic attraction would exist between the game board and the playing pieces. Other means of restraining the pieces could also be used.

In the three-dimensional version of my game, for example, the vertical recessed pathways 38 and the horizontal recessed pathways 39 could be replaced by recessed inverted T-shaped grooves, and an inverted T-shaped peg could be slid in these grooves, and the game could be played in the same fashion. Since it is obvious that many different ways of providing the player pieces can be provided, it should be understood that while these are within the scope of the invention, it is impractical to illustrate all such versions.

While the cover piece 32 is decorative, as well as serving the function of retaining the game pieces on the game board, where it is desired that it be removed for any reason, any one of the versions of my game previously described can be made in the version shown in FIG. 10. In this illustration there is shown a two-dimensional playing surface 65 having a circular retaining wall 66 extending therefrom. The height of the retaining wall may vary, but preferably should be at least half the dimension of the game pieces used on the playing surface 65 to retain the playing pieces thereon. In this version, the vertical linear pathways 16 and the horizontal linear pathways 17 form a series of rows and columns connected by the connecting pathway 22. Since a two-dimensional version of my game is being shown, the playing pieces may be the red game pieces 18 or the black game pieces 19 previously illustrated with the version of the game described in FIG. 1.

If it is desired to have this version of the game use the spherical playing pieces, such as those illustrated by the numeral 34 in FIG. 6, this version of my game may be modified, as shown in FIG. 12, to provide the three-dimensional version. In this case, the playing surface is made similar to that illustrated in FIG. 6, wherein there is a playing surface 35, a lower surface 36, a plurality of vertical linear recesses 38, and horizontal linear recesses 39. The vertical recesses 38 and the horizontal recesses 39 are shown in the form of intersecting rows and columns.

In this version of my game, since there is a retaining wall 66, the recessed connecting pathway 40 may be omitted, if desired, but also may be printed or otherwise illustrated on the playing surface 35. Stop means 45 are again provided at the intersection of the vertical recesses 38 and the horizontal recesses 39. For ease of handling, a lip 67 may be provided at the bottom of the circular retaining wall 66.

Figure 13:
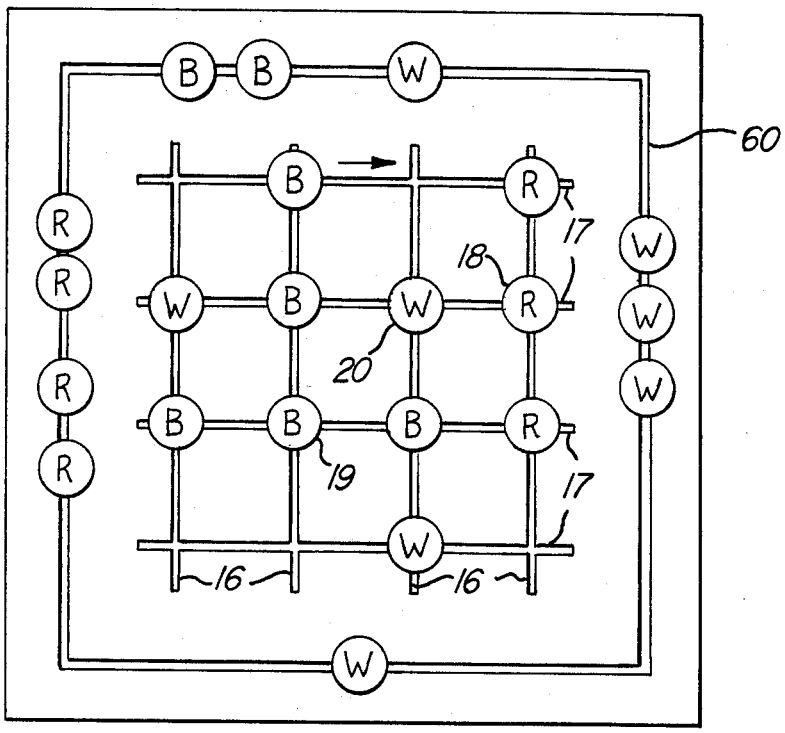
FIG. 13 is a perspective view of a further modification of a construction embodying my invention wherein the two-dimensional game board has pathways of movement in the form of four rows and four perpendicular intersecting columns, and the game board is adapted to be used by three players.

If a two-dimensional version of my improved board game is desired which may be played by three players and have three different colors of playing pieces, the version illustrated in FIG. 13 may be provided. There is shown, similar to the version illustrated in FIG. 1, a first plurality of spaced apart pathways, in this case four parallel vertical linear pathways 16, and a second plurality of spaced apart pathways, such as the four horizontal linear pathways 17. In this case, the four vertical linear pathways 16 intersect the four horizontal linear pathways 17 at right angles thereto to form four rows and four columns.

In this instance, since the game is to be played by three players, there are a plurality of red game pieces 18, black game pieces 19, and white game pieces 20. There is illustrated a number of each playing piece which is equal to the sum of the rows and columns, and the number of players is one less than the number of rows or columns where there is an equal number of rows and columns. In this case, since the number of rows plus the number of columns add up to eight, there are seven playing pieces in each of three colors.

A nonintersecting connecting pathway 60 is illustrated, although the ends of the rows and columns 16 and 17 may be extended to connect with the pathway. The game is played in the same manner as before, but although there are additional rows and columns, and additional playing pieces, the game is still won by getting two rows of three each, as this has been found to provide the most excitement when playing the game.

It is to be understood, of course, that alternate rules may be made if desired, and still be within the scope of the present invention. As illustrated, the player having the black playing pieces 19 has won, because he has a vertical row of three black playing pieces and a connecting horizontal row of three black playing pieces.

Figure 14:
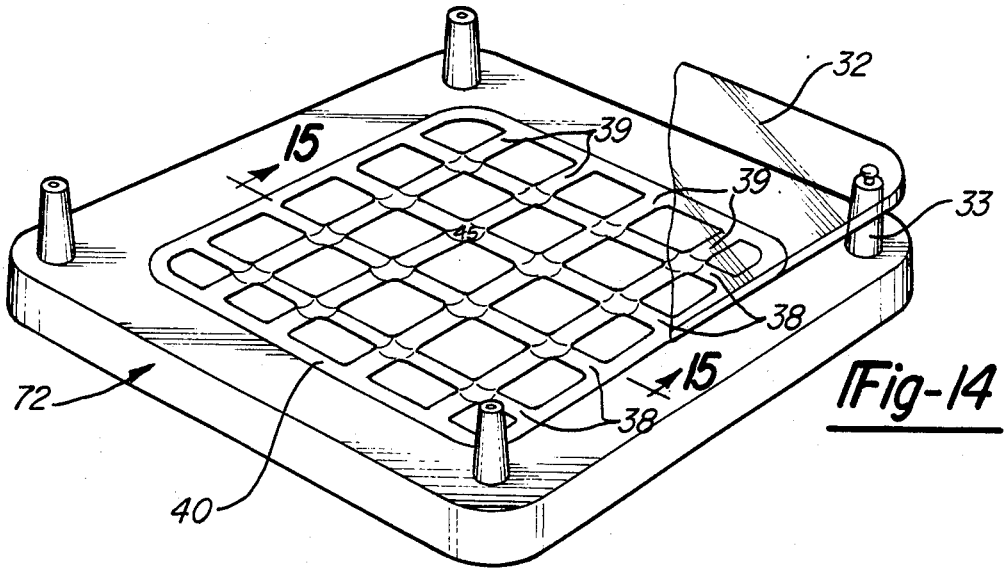
FIG. 14 is a perspective view of a further modification of my invention, similar to that shown in FIG. 6, but having additional paths of movement thereon so the board can be used by three players.
Figure 15:
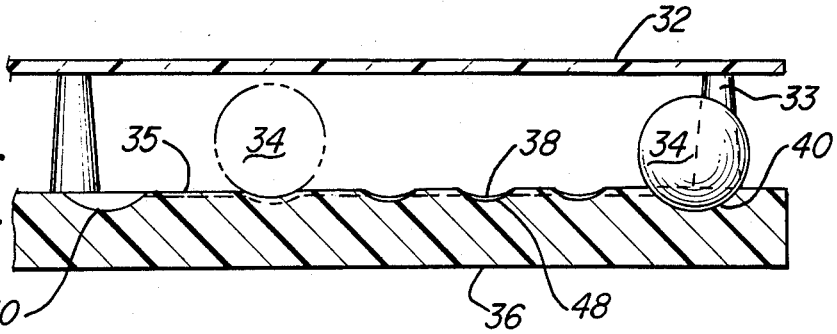
FIG. 15 is a partial sectional view taken in the direction of the arrows along the section line 15—15 of FIG. 14.

The three-player version of my improved board game illustrated in FIG. 13 in a two-dimensional version may also be made in a three-dimensional version, as illustrated in FIGS. 14 and 15. The construction of this version of my game is very similar to that illustrated in FIGS. 6–8.

In the three-player three-dimensional version of my game, a four-by-four game board, so called because there are four parallel vertical recesses 38 and four parallel horizontal recesses 39 intersecting at right angles, is provided and is generally designated by the numeral 72.

Similarly to that described in connection with FIG. 6, a recessed connecting pathway 40 is provided, which may be recessed more deeply than the vertical recesses 38 or the horizontal recesses 39. Stop means 45 are provided at the intersections of the horizontal and vertical recesses 38 and 39 respectively, and may again be in the form of the disk-shaped recess 48 illustrated in FIG. 8 for the three-by-three version of my game.

As before, the horizontal and vertical recesses are provided in a playing surface 35. The game board has a lower surface 36, and plurality of posts 33 depend from the playing surface 35 to support the cover piece 32.

The three-player three-dimensional version of my improved board game is played exactly like that described in connection with the playing of the two-dimensional version in FIG. 13, except that the spherical playing pieces 34 in various colors are used, instead of the circular playing pieces 18, 19 and 20 described for the two-dimensional version. Again, even though there are four rows and columns, and three colors of playing pieces, in the preferred version of the three-player game, two rows of three like colors are all that is required to win.

It should be understood, of course, that the number of rows and the number of columns formed by the vertical recesses 38 and the horizontal recesses 39 could be increased to any practicable number and still be within the scope of my invention. Likewise, as the number of rows and columns increases, the number of players can be increased, and the length of the rows for winning the games, and their number, may also be increased and still be within the scope of the present invention. Only two-dimensional and three-dimensional versions for two and three players have been described for ease of illustration and understanding.

Thus, by abandoning traditional methods of play of board games, I have provided a novel board game and method of play thereof, as well as a novel game board.

I claim:

1. A game board including:

(a) a playing surface;

(b) a first plurality of recessed vertical spaced apart pathways on said playing surface;

(c) a second plurality of recessed horizontal spaced apart pathways on said playing surface intersecting said first plurality of pathways; and (d) a continuous connecting pathway recessed into said playing surface, and connecting all of said first plurality of pathways and said second plurality of pathways at the ends thereof, said recessed continuous connecting pathway performing a storage function and not forming any part of the playing surface, said connecting pathway being more deeply recessed into the face of said game board than said first plurality or said second plurality of pathways.

2. The device defined in claim 1, wherein positive stop means are provided at each intersection of said first plurality of pathways and said second plurality of pathways.

3. The device defined in claim 2, wherein said stop means are in the form of deeper recesses at each point of intersection.

4. The device defined in claim 3, and including:

(a) a plurality of upstanding support posts depending from said playing surface of said game board; and (b) a cover plate fastened to said plurality of posts parallel to said playing surface of said game board.

5. The device defined in claim 1, wherein:

(a) said playing surface is circular in nature; and (b) a continuous circular retaining wall depends upwardly from said playing surface.

6. The device defined in claim 5, and including:

(a) a lip formed at the bottom of said circular retaining wall and projecting below a lower surface provided on said game board.

7. A board game including:

(a) a game board having a playing surface;

(b) a first plurality of recessed vertical spaced apart pathways on said playing surface;

(c) a second plurality of recessed horizontal spaced apart pathways on said playing surface intersecting said first plurality of pathways; and (d) a plurality of game playing pieces; and (e) a continuous connecting pathway recessed into said playing surface and connecting all of said first plurality of pathways and said second plurality of pathways at the ends thereof, said recessed continuous connecting pathway performing a storage function and not forming any part of the playing surface and being more deeply recessed into said playing surface of said game board than said first plurality or said second plurality of pathways.

8. The game defined in claim 7, wherein stop means are provided at each intersection of said first plurality of pathways and said second plurality of pathways.

9. The game defined in claim 8, wherein said stop means are in the form of deeper recesses at each point of intersection.

10. The game defined in claim 9, and including:

(a) a plurality of upstanding support posts extending from said playing surface of said game board; and (b) a cover plate fastened to said plurality of posts parallel to said playing surface of said game board.

11. The game defined in claim 10, wherein said cover plate is spaced from said playing surface of said game board an amount slightly less than the height of said game playing pieces.

12. The game defined in claim 11, wherein said game playing pieces are round in nature.

13. The game defined in claim 12, wherein said game playing pieces are spherical in nature.

14. The game defined in claim 13, wherein the number of said first plurality of pathways and said second plurality of pathways are equal.

15. The game defined in claim 14, wherein said game playing pieces are provided in different colors, so that each player will play with one of said different colors, the number of colors being one less than the number of said first plurality of parallel, spaced apart, pathways.

16. The game defined in claim 15, wherein the number of game playing pieces of each color is equal to the summation of the number of pathways in said first plurality of pathways and the number of said pathways in said second plurality of pathways.

17. The game defined in claim 15 or 16, and having:

(a) three vertical linear pathways forming said first plurality of pathways; and (b) three horizontal linear pathways forming said second plurality of pathways.

18. The device defined in claim 15 or 16, and including:

(a) four vertical linear pathways forming said first plurality of pathways; and (b) four horizontal linear pathways forming said second plurality of pathways.

19. A novel method of game play, including the steps of:

(a) providing a plurality of game playing pieces in at least two colors;

(b) providing each player with all the game pieces of a single color;

(c) providing a playing surface having a first plurality and second plurality of spaced apart pathways recessed into said playing surface and a connecting groove connecting the ends of said first plurality and said second plurality of spaced apart pathways, said connecting groove being more deeply recessed into the face of said game board than said first plurality or said second plurality of pathways, and performing of the playing surface;

(d) having each player put all his game playing pieces into said connecting groove in any order he wishes; and (e) alternately having each player move one of his playing pieces into one of said first plurality of passageways or said second plurality of passageways until one of said players forms two rows of like colored playing pieces, said rows not necessarily connecting with each other, and all without having any player reverse the immediately preceding move of another player.

20. The method defined in claim 19, wherein the step of providing a first plurality of spaced apart pathways on said game playing surface includes the step of:

(a) providing three parallel vertical linear pathways or columns.

21. The method defined in claim 19, wherein the step of providing a second plurality of spaced apart pathways on said game playing surface includes the step of providing:

(a) three parallel horizontal linear pathways.

22. The method defined in claim 19, wherein the step of providing a first plurality of spaced apart pathways on said game playing surface includes the step of:

(a) providing four parallel vertical linear pathways.

23. The method defined in claim 19, wherein the step of providing a second plurality of spaced apart pathways on said game playing surface includes the step of providing:

(a) four parallel horizontal linear pathways or rows.

* * * * *